US005381639A

United States Patent [19]

Calvert et al.

[11] Patent Number: 5,381,639

[45] Date of Patent: Jan. 17, 1995

[54] MACHINE FOR LOADING OPEN TOP STYLE CARTONS AT HIGH SPEEDS

[75] Inventors: Rodney K. Calvert, Dunwoody; Alton J. Fishback, Austell, both of Ga.

[73] Assignee: The Mead Corporation, Dayton, Ohio

[21] Appl. No.: 153,208

[22] Filed: Nov. 16, 1993

[51] Int. Cl.[6] ..... B65B 21/06; B65B 21/12

[52] U.S. Cl. ..... 53/48.1; 53/246; 53/247; 53/534

[58] Field of Search ..... 53/244, 246, 534, 247, 53/48.1

[56] References Cited

U.S. PATENT DOCUMENTS

| | | | |
|---|---|---|---|
| 4,389,832 | 6/1983 | Calvert | 53/534 |
| 5,020,306 | 6/1991 | Raudat | 53/246 |
| 5,212,930 | 5/1993 | Raudat | 53/263 |
| 5,241,805 | 9/1993 | Johnson | 53/534 |

*Primary Examiner*—John Sipos
*Assistant Examiner*—Gene L. Kim
*Attorney, Agent, or Firm*—Rodgers & Rodgers

[57] ABSTRACT

A carton loading machine is effective to load bottles packaged in basket style or in sleeve style cartons at high speed and with minimal attention by the operator due to the dual function of many of the machine parts.

6 Claims, 7 Drawing Sheets

MACHINE FOR LOADING OPEN TOP STYLE CARTONS AT HIGH SPEEDS

TECHNICAL FIELD

This invention relates to a machine for automatically drop loading bottles into open top cartons at high speed.

BACKGROUND ART

U.S. Pat. No. 4,389,832 issued Jun. 28, 1983 and owned by the assignee of this invention discloses and claims apparatus for loading bottles into basket style bottle carriers.

SUMMARY OF THE INVENTION

According to this invention in one form, a row of open top style cartons are supplied under line pressure to a loading station and a pair of spaced apart parallel belts having bottle engaging lugs are provided for supplying two rows of bottles to the loading station. An endless chain disposed in a vertical plane and generally below the loading station includes upwardly inclined segments and a plurality of upright studs mounted on the chain and arranged to enter the loading station from below in sequence.

These studs serve to aid in guiding drop loaded bottles into the cartons and may include longitudinal and transverse slots for receiving medial and transverse partition panels. When loading open top cartons these studs are inserted in apertures formed in the carton bottom wall.

According to one version of this invention, a rotatable loading disk is disposed above the loading station and is provided with a plurality of pairs of knobs disposed about the periphery of the disk and arranged with the knobs of each pair on opposite surfaces of the disk which serve to aid in guiding drop loaded bottles into cartons while passing through at the loading station.

BEST MODE OF CARRYING OUT THE INVENTION

Figure 1:
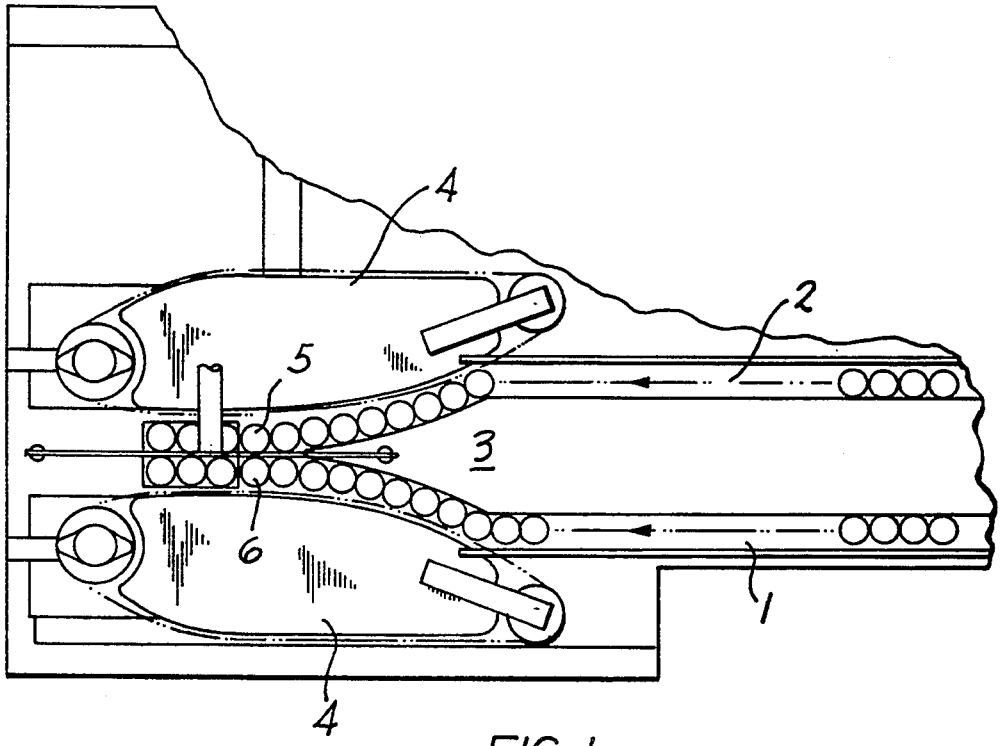
FIG. 1 is a plan view from above of the overall arrangement of the machine components.
Figure 3:
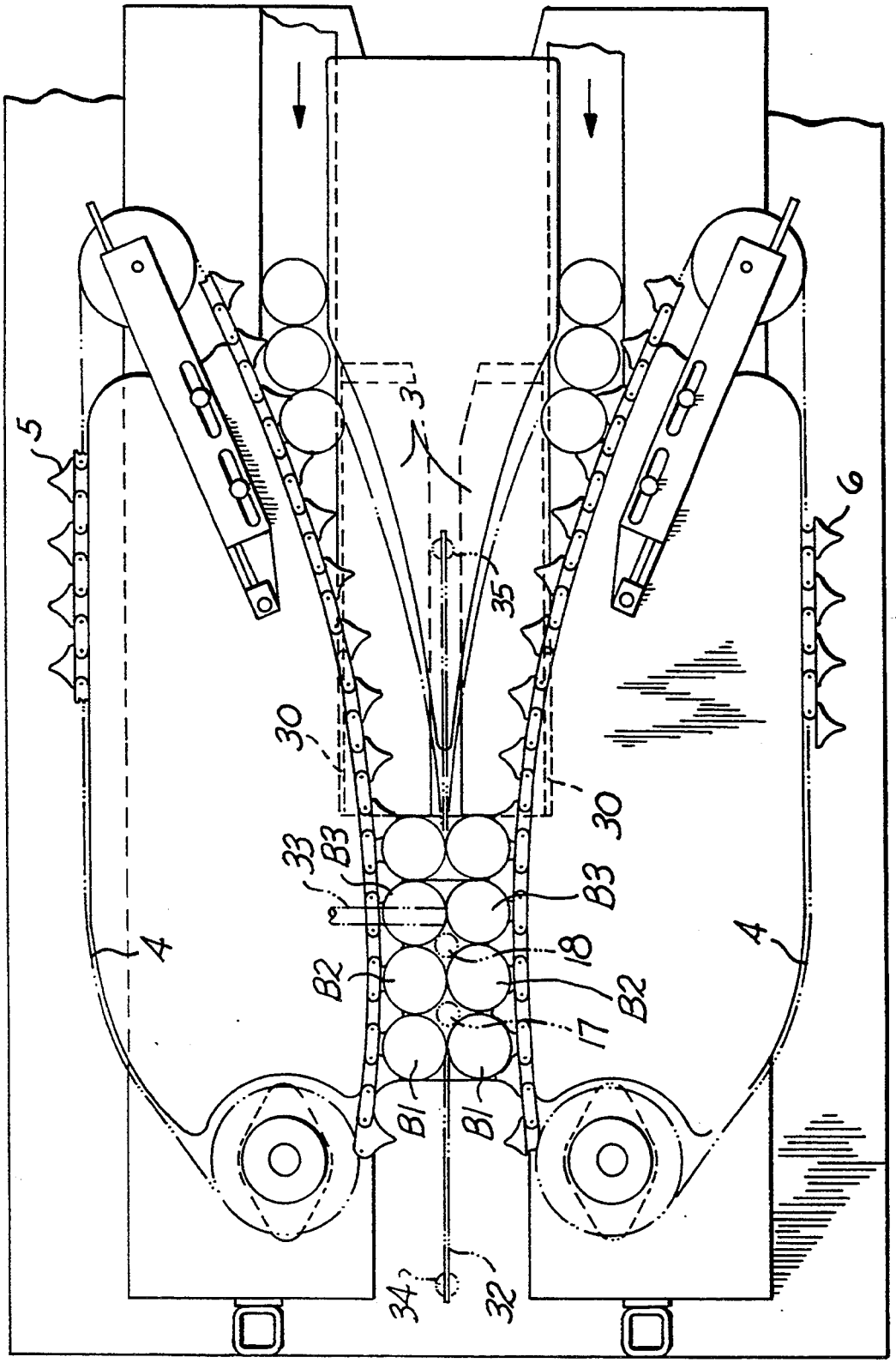
FIG. 3 is an enlarged fragmentary view of the left hand end of FIG. 1.

With reference to FIG. 1, bottles are fed by a pair of infeed parallel moveable belts 1 and 2 and a structure designated by the numeral 3 converges the two rows of bottles into closely spaced relation with respect to each other and onto a pair of bottle pusher elements 4. Each row of bottles is supplied at line pressure to an endless chain of bottle engaging lugs such as are indicated at 5 and 6 on supports 4 respectively as best shown in FIG. 3.

Figure 2:
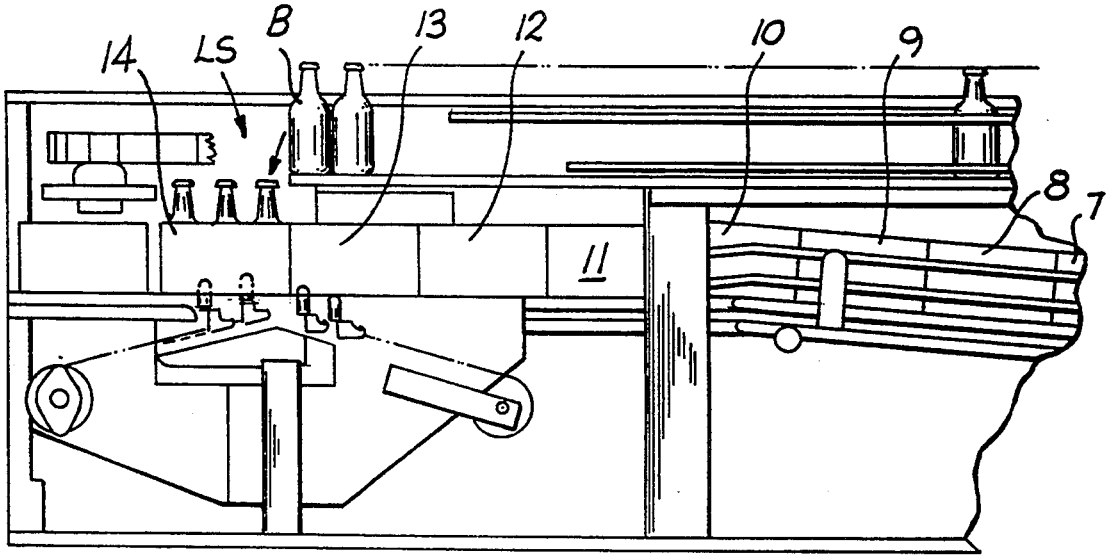
FIG. 2 is a side view of FIG. 1.

As best shown in FIG. 2, cartons designated by the numerals 7–14 inclusive are fed under line pressure to the loading station generally designated at LS where the bottles B are drop loaded into a carton such as 14.

Figure 4:
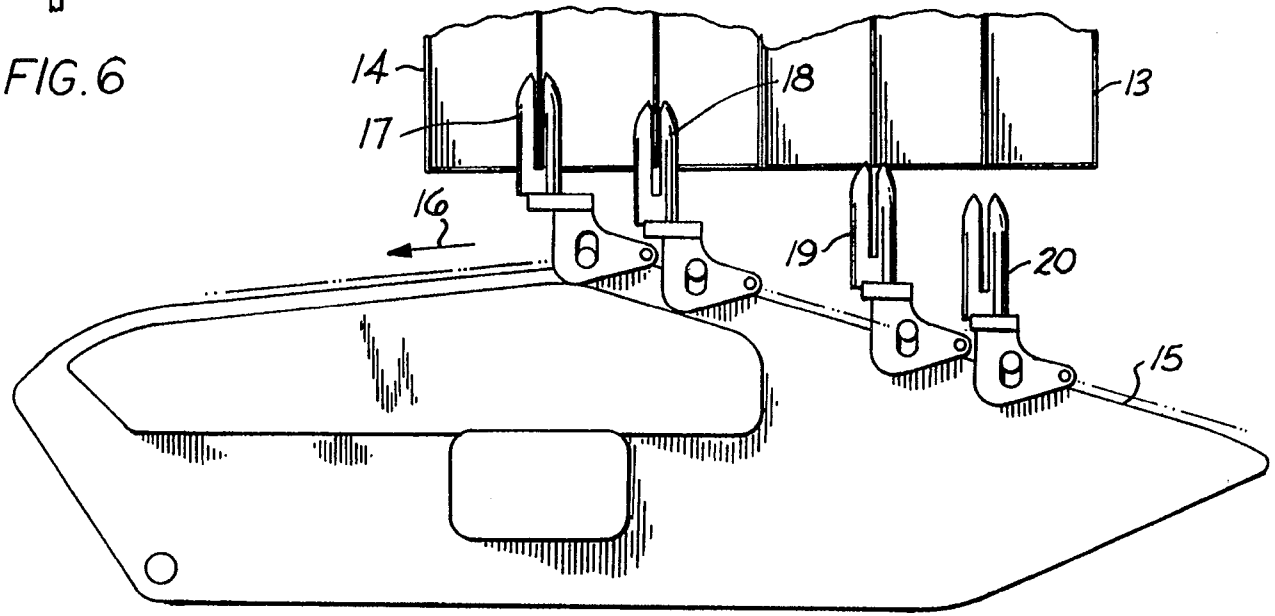
FIG. 4 is an enlarged view of the left hand end of FIG. 2.
Figure 5:
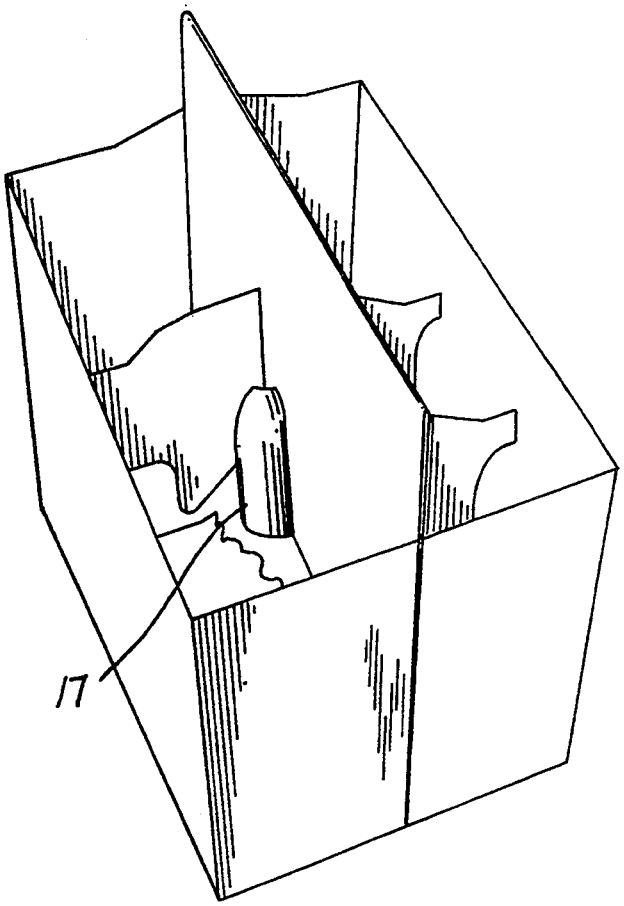
FIG. 5 is a perspective view of a partitioned style carton which is loaded by the machine of the invention.
Figure 10:
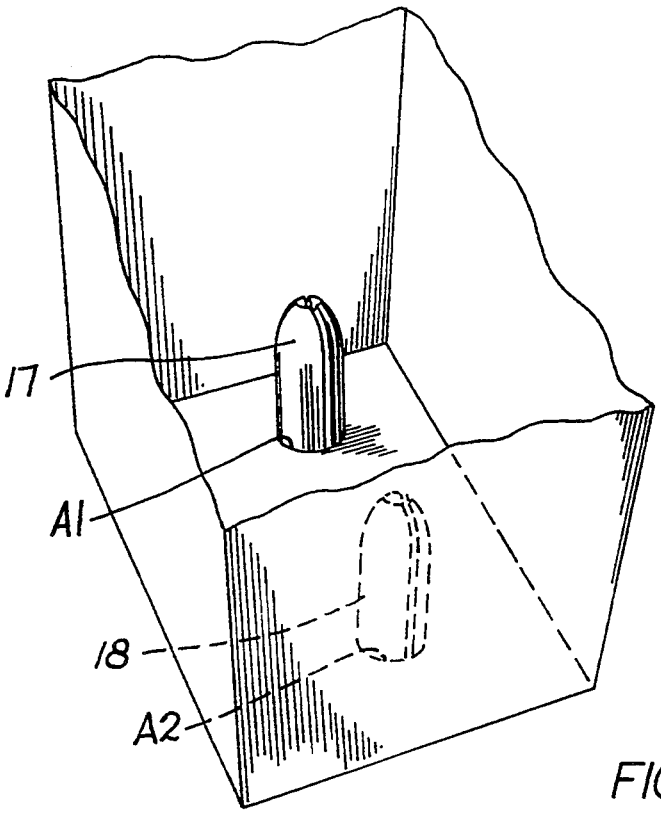
FIG. 10 is a perspective view of an open top carton without internal partitions which is loaded by the machine of this invention.

An endless chain 15 is driven in a counterclockwise direction as indicated by the arrow 16 in FIG. 4. Studs movably mounted on track 15 are designated by the numerals 17, 18, 19 and 20. Track 15 is upwardly inclined in the machine direction so that the studs enter sequentially into apertures in the bottom panels of the cartons. As indicated in a perspective view designated FIG. 5 partitioned cartons such as 13 and 14 in FIG. 4 are provided in their bottom panels with apertures A1 and A2 (FIG. 10). As shown in FIG. 4 the studs 17 and 18 are in the process of entering the apertures in the bottom of carton 14 while the studs 19 and 20 are approaching entry into the apertures formed in the bottom of carton 13. The studs 17 and 18 are shown in FIGS. 3, 6, 7, 8 and 9 and serve to register the carton with reference to the movement of the bottle engaging lugs 5 and 6.

Figure 7:
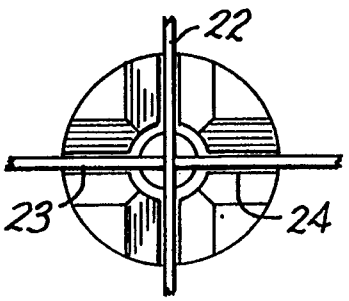
FIGS. 6, 7, 8 and 9 show details of machine components used in loading partitioned style cartons.
Figure 6:
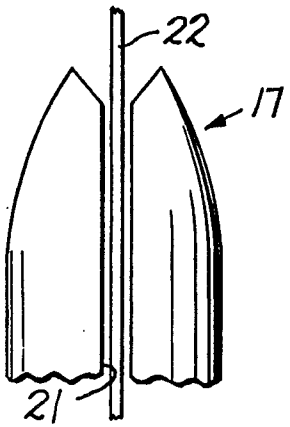
Figure 8:
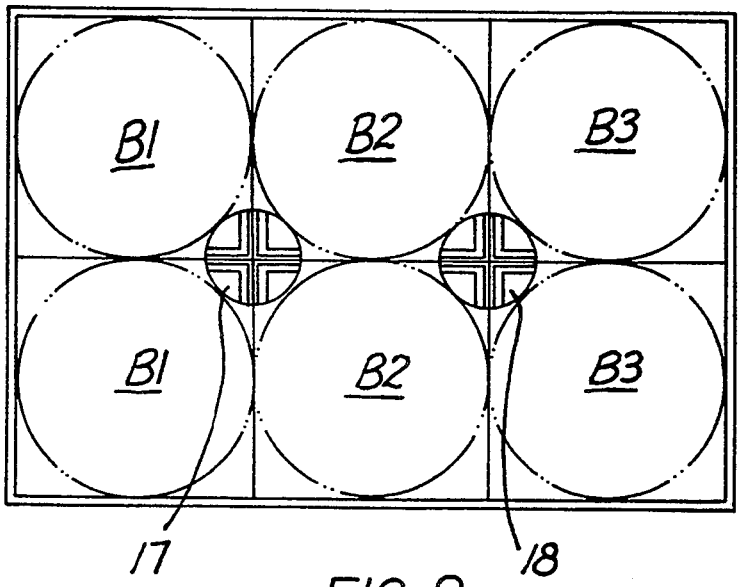
Figure 9:
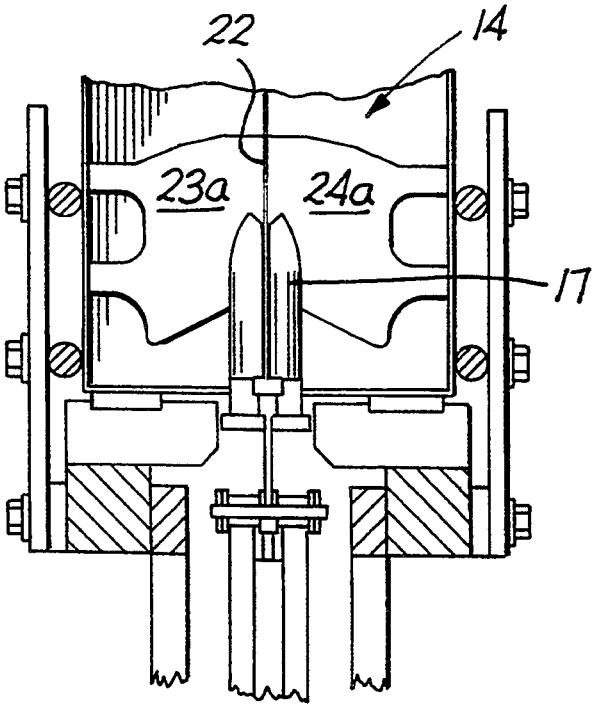

With reference to FIG. 6, a vertically disposed slot 21 is formed in the studs such as 17–20 and a medial partition panel such as 22 is disposed within the vertical slot 21. As is best shown in FIG. 7, a transverse slot 23 is formed on one side of panel 22 and another transverse slot 24 is formed on the opposite side of the stud. In FIG. 9, transverse panels 23*a* and 24*a* are formed and are disposed within the transverse slots 23 and 24. As shown in FIG. 9, stud 17 is in its uppermost position of cooperation with the medial panel 22 of carton 14 and transverse panels 23*a* and 24*a* are disposed within the slots 23 and 24 in stud 17. As shown in FIG. 4, the stud 17 is in a position of cooperation with the carton 14. This cooperation of parts serves to position the carton such as 14 precisely with respect to other machine elements thereby to facilitate smooth rapid operations of the loading machine. FIG. 8 simply shows schematically the appearance of a partitioned carrier with the studs such as 17 and 18 disposed within spaces within the carton due to the cylindrical configuration of the bottles B.

FIG. 3 shows lugs 5 which advance the bottles in a controlled fashion. The studs such as 17 and 18 enter apertures in the carton bottom walls and serve to correctly position and move the carton in a synchronized fashion.

Figure 11:
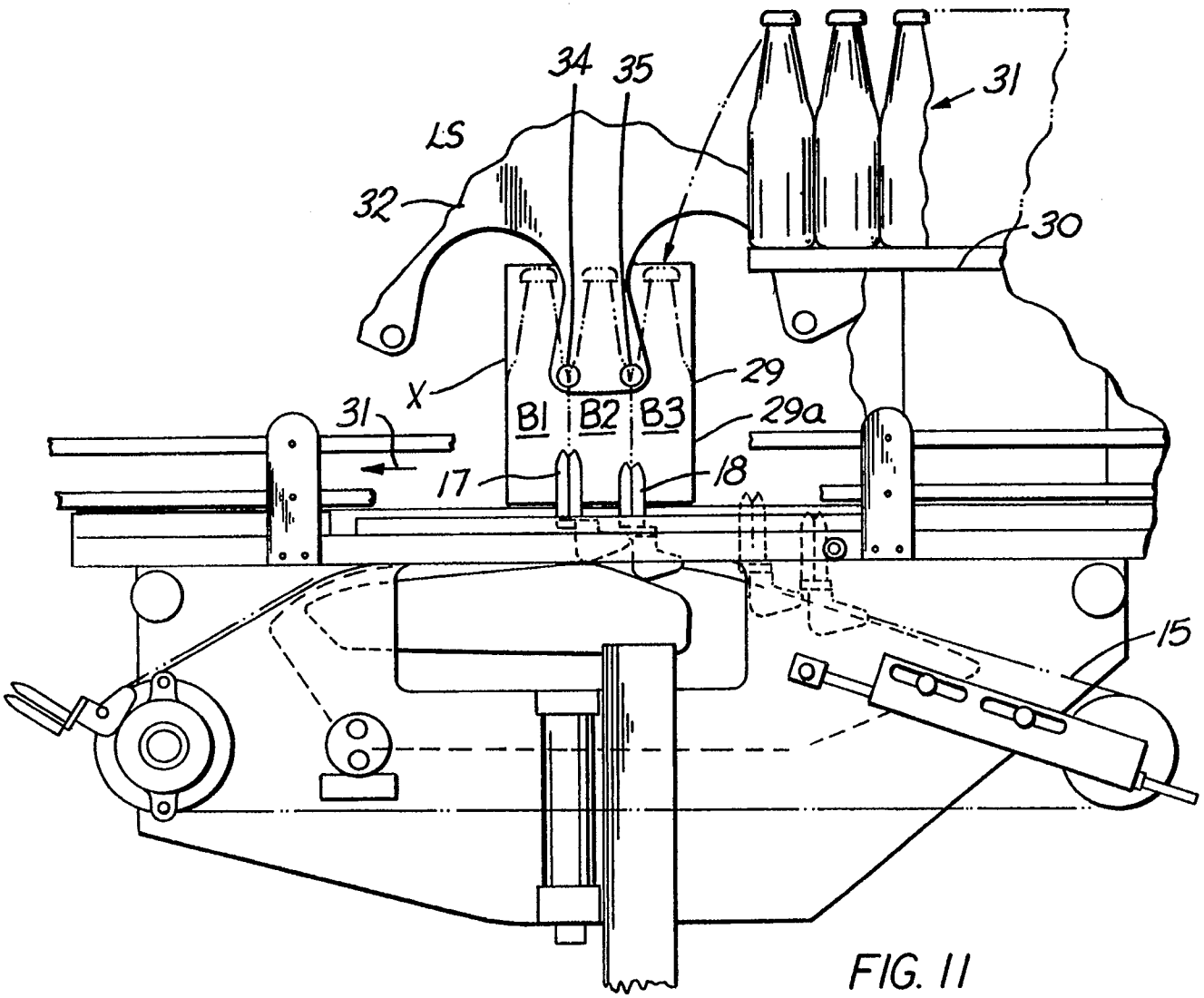
FIGS. 11 and 12 are enlarged side views of the loading station which is shown in use in connection with the loading of open top cartons without partitions.
Figure 12:
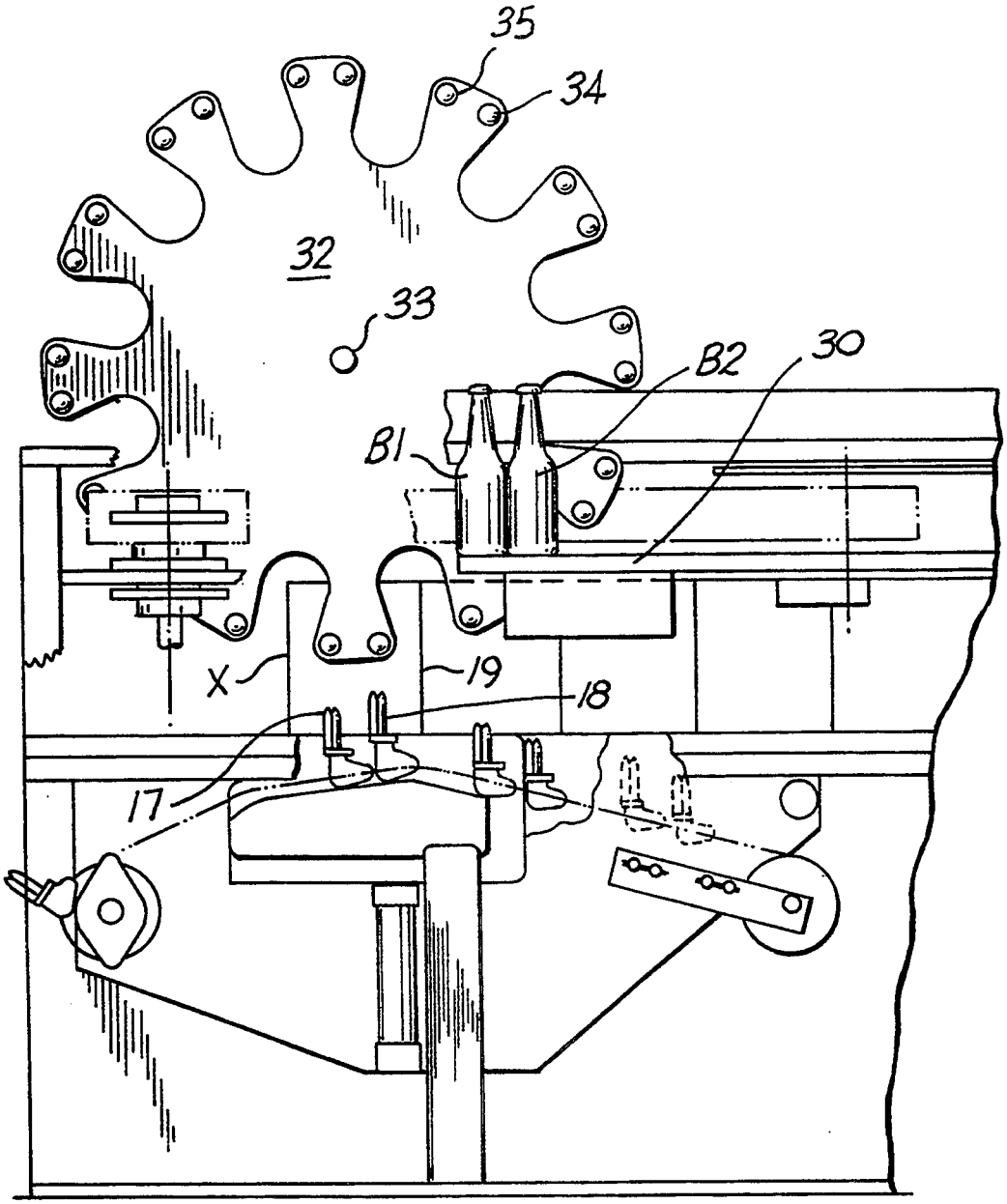

When the machine is used in conjunction with open top cartons without internal partitions, a disk 32 with knobs 34 and 35 is used to guide the bottles as they move downwardly into the carton as shown in FIGS. 11 and 12. The peripheral projections of the disc move in sequence in and out of the carton being loaded. The lugs 5 and 6 serve to control the associated bottles during the initial part of downward movement. After downward movement of a bottle has progressed to some degree the knobs on disc 32 serve to continue guidance until the studs such as 17 and 18 provide guidance as a particular bottle reaches its lowermost position. Knobs on disc 32 are disposed so that the knobs on opposite surfaces of disc 32 are disposed about the bottles on opposite sides of disc 32. Rotation of disc 32 serves to cause the knobs to enter and then leave the bottle group. The cartons and bottles move continuously through the loading operations.

With reference to FIG. 11, the chain 15 is shown and the studs 17 and 18 are shown in the positions they occupy briefly while the open top carton is moved through the loading station LS. The near side wall of the carton is removed for the sake of clarity.

As is clear from FIG. 11, the incoming bottles are supported on discharge plate 30 and move continuously from right to left as indicated by the arrow 31. This drop loading operation is effectively controlled and facilitated by the loading disk 32 shown in FIGS. 11 and 12. This loading disk is rotatable clockwise about a fixed shaft 33 at constant speed and is provided with a plurality of pairs of knobs such as 34 and 35. These knobs are provided on both surfaces of the disk 32. FIG. 3 shows lugs 5 and 6 which control the movement of the two rows of bottles in a precise synchronized movement.

As shown in FIG. 12, the bottles such as B1 and B2 are resting on the discharge plate 30. Bottle B1 of course is the first bottle to slide off of discharge plate 30 and into the carton 29. As bottle B1 slides off of plate 30 and downwardly into the position indicated at B1 in FIG. 11, the downward fall of the bottle B1 is guided initially by the lugs 5 and 6 and by the end wall X of the carton 29 on one side and by the knob such as 34 and the stud such as 17 on the other side. This downwardly guided path of movement of bottles B1 constitutes an important feature of this invention and serves to facilitate safe controlled loading movement of the bottle B1 into the carton as shown in FIG. 11 thus expediting the speed of the overall operation. After the B1 bottles are loaded, the carton 29 is moved to position the bottles B2 for drop loading from discharge plate 30. During this operation, knobs 34 and 35 guide the bottles B2 downwardly along with the action of studs 17 and 18 to allow bottles B2 to arrive at their loaded positions without damage and at high speed. In similar fashion bottles B3 slide off of discharge plate 30 and engage knobs 35 as well as stud 18 and end wall **29*a* of the carton 29 to allow settling movement of the bottles B3** into loaded position.

Studs such as 17 and 18 also position and register the cartons. Simultaneous movement of bottles B1, B2, and B3 as described above obviously apply to each pair of transversely aligned bottles.

Once the loading operation is completed, studs 17 and 18 move downwardly and to the left under the control of chain 15 as is obvious.

As is apparent, the machine according to this invention is operable to load two types of open type cartons, i.e., a basket style having a medial handle and cross partitions as well as open top cartons which do not include a handle or cross partitions. These cartons may be loaded with minimal attention to adjustment of cooperating elements and thus at high speeds. One machine can load two different styles of cartons in a safe, efficient and rapid manner without major adjustments. In applications of the invention to basket style cartons, the disc 32 is removed.

We claim:

1. A machine for drop loading bottles into open top cartons having upstanding side and end walls and a bottom wall provided with at least one aperture, the machine comprising a loading station, conveyor means for supplying a series of said cartons in end to end abutting relationship to said loading station, conveyor means including spaced apart parallel belts having a series of bottle engaging lugs for supplying two rows of bottles to said loading station, an endless chain disposed in a vertical plane and generally below said loading station, a plurality of upright studs mounted on said chain and arranged to enter through said aperture in said bottom wall of each carton, said bottle engaging lugs and said studs being synchronized and effective to register said cartons at said loading station and to guide said bottles as they drop into said cartons a rotatable vertically disposed disc provided above said loading station and arranged for partial entry into each carton from above and between the bottles of each pair of bottles, said disc having radial projections formed along the periphery thereof and a plurality of knobs formed on each of said projections on opposite sides of said disc, a plurality of pairs of knobs formed on said disc near the periphery of said disc with the knobs of each pair of knobs on opposite surfaces of said disc, radial projections formed about the periphery of said disc and wherein at least one pair of knobs is disposed on each side of each of said radial projections.

2. A carton loading machine according to claim 1 wherein a longitudinal slot is in each of said studs.

3. A carton loading machine according to claim 2 wherein a pair of transverse slots are in each of said studs.

4. A carton loading machine according to claims 1 or 2 wherein the cartons are of basket style having a medial keel arranged for insertion into said longitudinal slot.

5. A carton loading machine according to claims 1 or 3 wherein the cartons are of basket style having a pair of transverse partitions arranged for insertion into said transverse slots respectively.

6. A carton loading machine according to claim 1 wherein a recessed area is disposed between each adjacent pair of said radial projections.

* * * * *